US009359734B2

(12) United States Patent
Favorito et al.

(10) Patent No.: US 9,359,734 B2
(45) Date of Patent: Jun. 7, 2016

(54) SNOW PLOW-BLOWER

(71) Applicants: Paul Favorito, Morganville, NJ (US); Francesco Marino, Staten Island, NY (US)

(72) Inventors: Paul Favorito, Morganville, NJ (US); Francesco Marino, Staten Island, NY (US)

( * ) Notice: Subject to any disclaimer, the term of this patent is extended or adjusted under 35 U.S.C. 154(b) by 450 days.

(21) Appl. No.: 13/694,260

(22) Filed: Nov. 13, 2012

(65) Prior Publication Data

US 2014/0130384 A1 May 15, 2014

(51) Int. Cl.
*E01H 5/09* (2006.01)
*E01H 5/04* (2006.01)

(52) U.S. Cl.
CPC .. *E01H 5/09* (2013.01); *E01H 5/04* (2013.01); *E01H 5/098* (2013.01)

(58) Field of Classification Search
CPC ..... E01H 5/04–5/098
USPC ..... 37/242, 241, 254, 222, 248, 253, 209, 37/211, 212, 214, 216, 223
See application file for complete search history.

(56) References Cited

U.S. PATENT DOCUMENTS

| | | | | | |
|---|---|---|---|---|---|
| 1,433,188 | A | * | 10/1922 | Day | 37/248 |
| 1,552,714 | A | | 9/1925 | Linzy | 37/248 |
| 1,594,095 | A | * | 7/1926 | Fey et al. | 37/248 |
| 2,218,512 | A | * | 10/1940 | Ball | 37/279 |
| 2,769,254 | A | * | 11/1956 | Wright | E01H 8/06 37/105 |
| 2,777,218 | A | | 1/1957 | Kiecker et al. | 37/256 |
| 2,827,714 | A | * | 3/1958 | Hyde | 37/242 |
| 3,213,552 | A | * | 10/1965 | Vanvick | 37/252 |
| 3,309,798 | A | * | 3/1967 | Devlin et al. | 37/228 |
| 3,424,251 | A | * | 1/1969 | Bouley | 172/810 |
| 3,477,151 | A | * | 11/1969 | Zanella | 37/281 |
| 3,766,586 | A | | 10/1973 | Krickovich | 15/83 |
| 3,807,064 | A | * | 4/1974 | Schmidt, Jr. | 37/283 |

(Continued)

FOREIGN PATENT DOCUMENTS

| | | | |
|---|---|---|---|
| CA | 646078 | 8/1962 | |
| CA | 2133495 | 12/1993 | E01H 5/04 |

(Continued)

OTHER PUBLICATIONS

"Crafts Manual-Stage Snow Blower Tractor Attachment" found at http://www.searsoutlet.com/d/product_details.jsp?pid_41354&mode=buyUsedOnly&sid=IDx20110411x000008&ci,_sku=8797230&ci_gpa=pla&ci_kw={keywork}.

*Primary Examiner* — Thomas B Will
*Assistant Examiner* — Joan D Misa
(74) *Attorney, Agent, or Firm* — Ernest D. Buff; Ernest D. Buff & Associates, LLC.; Margaret A. LaCroix, Esq.

(57) ABSTRACT

A snow plow-blower operates as a snow plow, snow blower, or as a snow plow-blower combination. The device includes a plow head blade optionally having retractable/pivotal scoop wings and a cavity with an aperture with blower doors and a blower unit. The snow blower unit includes an auger and impeller to move snow into the unit and force it out of a discharge chute. Blower doors are provided over the snow blower unit cavity to prevent snow from entering into the cavity when the blower is off. Optionally, the blower doors move along a track and rest flush against the plow head to open and close off access to the cavity. Alternatively, the blower doors are hingedly mounted to pivot to open and closed positions. The blower doors may be constructed to operate as blower blades to direct snow into the blower unit; alternatively, separate blower blades are provided to optimize snow removal and mitigate jamming/clogging.

27 Claims, 14 Drawing Sheets

(56) References Cited

U.S. PATENT DOCUMENTS

| | | | | | |
|---|---|---|---|---|---|
| 3,911,601 | A | | 10/1975 | Maheu | 37/253 |
| 4,023,287 | A | | 5/1977 | De Brito | 37/231 |
| 4,099,578 | A | * | 7/1978 | Stevens | 172/815 |
| 4,178,232 | A | | 12/1979 | Nollet | 209/3 |
| 4,226,034 | A | | 10/1980 | Benjamin et al. | 37/229 |
| 4,249,322 | A | | 2/1981 | Mclaughlin et al. | 37/196 |
| 4,356,645 | A | * | 11/1982 | Hine et al. | 37/281 |
| 4,479,312 | A | * | 10/1984 | Turgeon | 37/219 |
| 4,498,253 | A | * | 2/1985 | Schmidt | 37/249 |
| 4,715,134 | A | * | 12/1987 | Schmidt | 37/238 |
| 4,885,852 | A | | 12/1989 | Gudmundsson | 37/260 |
| 5,127,174 | A | | 7/1992 | Takeshita | 37/250 |
| 5,410,824 | A | * | 5/1995 | Pedersen | 37/242 |
| 5,438,770 | A | * | 8/1995 | Miller | 37/227 |
| 5,513,453 | A | | 5/1996 | Norton | 37/244 |
| 5,899,007 | A | * | 5/1999 | Niemela et al. | 37/281 |
| 5,915,835 | A | | 6/1999 | Fair | 37/241 |
| 6,154,985 | A | | 12/2000 | Champagne et al. | 37/222 |
| 6,247,254 | B1 | | 6/2001 | Wessman | 37/256 |
| 6,367,176 | B1 | | 4/2002 | Zaugg et al. | 37/240 |
| 6,412,199 | B1 | * | 7/2002 | Quenzi et al. | 37/281 |
| 6,513,267 | B2 | | 2/2003 | Yoshida et al. | 37/283 |
| 7,174,660 | B2 | | 2/2007 | Sakai et al. | 37/260 |
| 7,681,337 | B2 | * | 3/2010 | Watson | 37/281 |
| 8,191,289 | B2 | | 6/2012 | Raftery | 37/271 |
| 2002/0095824 | A1 | * | 7/2002 | Johnson | 37/241 |
| 2004/0216333 | A1 | | 11/2004 | Quenzi et al. | 37/281 |
| 2005/0241190 | A1 | | 11/2005 | Kettering et al. | 37/258 |
| 2009/0217554 | A1 | | 9/2009 | Tucker | 37/228 |
| 2009/0307941 | A1 | | 12/2009 | Gamble | 37/231 |
| 2010/0205834 | A1 | | 8/2010 | McKeown et al. | 37/197 |
| 2011/0067273 | A1 | * | 3/2011 | Koch et al. | 37/231 |
| 2011/0113657 | A1 | | 5/2011 | Mills | 37/266 |
| 2011/0239491 | A1 | | 10/2011 | Chen | 37/253 |
| 2012/0079749 | A1 | | 4/2012 | Dimario | 37/266 |
| 2012/0279093 | A1 | * | 11/2012 | Niemela et al. | 37/242 |
| 2013/0298429 | A1 | * | 11/2013 | Niemela et al. | 37/242 |

FOREIGN PATENT DOCUMENTS

| | | | | |
|---|---|---|---|---|
| JP | 63007414 | A * | 1/1988 | |
| JP | 2003041544 | | 2/2003 | E01H 5/09 |

* cited by examiner

SNOW PLOW-BLOWER

BACKGROUND OF THE INVENTION

1. Field of the Invention

The present invention relates to snow moving machines; and, more particularly, to a snow plow-blower apparatus adapted to be used in operation with a vehicle to plow and remove snow.

2. Description of the Prior Art

Snow removal is a tedious and costly operation for residents, municipalities and commercial enterprises. Snowplows (snow plows, snow ploughs or snow ploughs) are generally mounted on vehicles or winter service vehicles for use when removing snow and ice from outdoor surfaces such as roads and parking lots. In some instances, commercial vehicles are provided with snowplows fixedly mounted thereto. This fixed mounting structure is generally used with winter service vehicles. In other instances snowplows are removably mounted to pickup trucks, front end loaders, and/or tractors. Snowplows can also be mounted on rail cars to clear railway tracks. Snowplows function by using a blade to push snow to the side or straight ahead, clearing the snow from a surface. However, snow banks and piles build-up along the side of the roadway or the like, causing dangerous conditions and visibility issues at intersections and driveways. Moreover, as additional snow accumulates resultant snow banks or piles from plowing become increasingly difficult to manage.

Unlike snowplows, snow blowers enable the actual removal and throwing of snow from one location to another. Snow blowers or snow throwers generally involve machines for removing snow from an area where it is not wanted, such as a driveway, sidewalk, roadway, railroad track, rink, runway, or house. While snow throwers are generally similar to snow blowers, snow throwers involve machines that use a single stage to remove or "throw" snow while snow blowers use two stages to remove or "blow" snow. Such snow throwing and snow blowing devices typically use either electric power, or a gasoline or diesel engine to energize the throwing or blowing of snow to another location or into a truck to be hauled away. This throwing or blowing operation is in contrast with the action of snow plows, which merely push snow to the front or side.

In operation, snow blowers are broadly divided into two classes, single stage and two stages. Single-stage snow throwers implement a single high-speed impeller to both move the snow into the machine and force it out of a discharge chute. Two or more curved plastic paddles are usually utilized that move snow towards the center line of the machine where the discharge chute is located. These single-stage snow throwers usually are light-duty machines. In a two-stage machine, two mechanisms move the snow; an auger feeds the snow to a high-speed impeller, which blows the snow out of the machine. These two-stage snow blowers generally range from small machines having a few horsepower to commercial grade large machines powered by diesel engines of over 1000 horsepower (746 kW). Generally, the large machines are used for clearing roadways and airport runways, often by throwing the snow into trucks, which haul it away.

A variety of devices have been suggested for forming snow plow blower units. However, the heretofore known and utilized devices are prone to jamming, have safety issues, and fail to provide the ability to switch between snowplow mode and snow blower mode. Each year there are thousands of snow blower related injuries which require medical attention. One problem with the design of current snow blowers is that snow can build up in the auger, causing it to jam and stall the motor. Deformation of the auger often results if the motor is not stalled. Currently known and utilized devices are prone to jamming owing to the location of the snow blower in relation to the plow head. Often, the snow blower unit is located on the side of the snowplow blade wherein the snow is being plowed toward the blower unit which must operate quickly enough to throw the snow. If the blower is not operating quickly enough, snow begins to rapidly build-up against the blower, causing it to jam, rendering an unsafe condition and/or damage to the snow blower portion of the device. Various examples of heretofore disclosed and utilized devices are set forth herein below.

U.S. Pat. No. 1,552,714 to Linzy discloses a rotary snowplow. A chassis frame carries an engine, transmission, driving shaft and reverse control. At the front of the chassis is provided a housing carrying a peripherally mounted member. The rotary snowplow does not provide the ability to move from a plow mode to a snow blower mode, but merely provides for the modes to operate contemporaneously at the same time. If a user does not want to utilize the snow blower, the cavity remains uncovered and snow will accumulate and clog the blower, impeding its functionality.

U.S. Pat. No. 2,777,218 and counterpart Foreign Patent Publication No. CA646078 to Kiecker et al. disclose a combination snow plow and blower normally drawn by an implement such as a tractor. The snow plow and blower do not have the ability to move from a plow mode to a snow blower mode; but merely functions in a manner whereby the plowing and blowing modes must be operable at the same time. If a user does not want to utilize the snow blower, the snow blower cavity remains uncovered causing snow to accumulate and clog the blower mechanism.

U.S. Pat. No. 3,911,601 to Maheu discloses a snow blower vehicle comprising a snow plow assembly mounted on the front of a vehicle chassis. The snow plow assembly has an open fronted scoop and a scraper blade resiliently mounted on the lower edge of the scoop. A chute at the rear of the scoop opens onto the scoop along its length. The snow blower vehicle comprises a snow plow assembly that includes a blower having a jet type orifice, and being located on the side of the plow device. No covering is provided for the blower cavity area. Consequently, the blower cannot be optionally covered when not functioning. If an operator does not want to utilize the snow blower, the cavity remains uncovered and snow will accumulate and clog the blower mechanism.

U.S. Pat. No. 4,023,287 to De Brito discloses a plow attachment for a snow blower that may be pivoted between work and storage positions, about a horizontal axis located rearwardly of the snow blower blade, and may be angularly adjusted about a vertical axis. The plow attachment includes a frame and a blade which may be readily connected to and removed from the frame. It teaches a plow attachment for a snow blower wherein the plow attachment pivots upward and rearwardly to expose the snow blower. The unit does not provide for a snow plow and blower to be operated simultaneously. Rather, it discloses that the plow and blower can only be used unilaterally—one or the other at a time.

U.S. Pat. No. 4,249,322 to Mclaughlin et al. discloses a vehicle-mounted snowplow having a scoop with a large intake opening for receiving snow and air. The scoop tapers to a narrow throat connected to an outlet means. Air speed through the scoop is increased as the scoop narrows so that the air carries the scooped snow through the outlet means and discharges it from the outlet means at a high velocity. No disclosure is contained concerning a snow moving machine that can move from a plow mode to a snow blower mode.

Rather, it merely provides for the plowing and blowing modes to be operative at the same time. If a user does not want to utilize the snow blower, the cavity remains uncovered and snow will accumulate therein and clog the blower mechanism.

U.S. Pat. No. 5,127,174 to Takeshita discloses an improved snow thrower and specifically an improved blower that improves efficiency and reduces the likelihood of snow accumulation. The blower casing is connected to the auger housing by an exit opening that is disposed and sized so that snow blown by the blower will not reenter the auger housing. Not disclosed is a snow plow snow blower unit wherein one can intermittently utilize both the snow blower and plow, or in the alternative, utilize solely the plow function.

U.S. Pat. No. 5,513,453 to Norton discloses a combined snow plowing and snow throwing vehicle that includes an elongate plow blade at its forward end. The plow blade can be shifted to direct snow to either of the right or the left, and includes separate snow throwing fans mounted, respectively, at the right and left ends of the plow blade. A user-actuable control system provides independent actuation of the snow throwing structures so that the snow throwing structure at the downstream end of the plow blade is actuated regardless of whether the plow is directing snow to the right or to the left. The combined snow plowing and snow throwing vehicle throws snow by means of throwing structures; not by means of a snow blower structure. Moreover, the snow throwing structures are located on either end of the device and are not capable of being covered/closed if idle. The location of the throwers makes them susceptible to jamming with snow or rocks during use.

The vast majority of snowblowers and/or snow ploughs involve devices that involve interchanging from blower to plough with one functioning unilaterally, and do not provide the ability to use the functions simultaneously or alternatively depending on the function needed for the given snow clearing conditions.

For examples, see:

U.S. Pat. No. 5,915,835 to Fair discloses a snowblower including a housing. Attached to the snowblower is a drive mechanism that actuates a snow gate for movement about a vertical axis, inwardly towards and outwardly away from the snowblower housing. The snow gate engages a snow drift wall to reorient the snowblower with respect to the adjacent snow drift wall thereby preventing the snowblower from veering off the intended path and into an adjacent snow drift.

U.S. Pat. No. 6,154,985 to Champagne et al. discloses a device for use with a snow blower being of the type having an auger. The device allows the snow blower to operate while moving backwards. The device principally consists of a concave blade mounted on a snow blower, which pivots between an operative position where the blade extends close to ground and the concave surface of the blade extends in front of the auger in such a way that the blade scrapes the snow and directs it towards the auger when the snow blower is lifted up to let the snow pass under it and moves backwards, and an inoperative position where the blade is raised to a height sufficient to let the snow reach the auger when the snow blower moves forwards.

U.S. Pat. No. 6,367,176 to Zaugg et al. discloses a rotary snow blower plow with a plow worm which delivers the snow and a fan blower which throws the delivered snow. The fan blower is located on a line with the plow worm. The fan blower and the plow worm can be mounted on a common shaft so that they rotate with the same angular speed.

U.S. Pat. No. 6,513,267 to Yoshida et al. discloses a snow removing machine equipped with a snow removing plate. The snow removing plate is mounted to a front portion of a vehicle body which forms part of the snow removing machine. An operating handle having grip portions is mounted to a rear portion of the vehicle body and obliquely extends upward.

U.S. Pat. No. 7,174,660 to Sakai et al. discloses a snow removing machine having an auger for plowing and collecting snow, a rotatable blower for throwing snow collected by the auger, and a shooter for guiding the snow thrown by the blower so that the snow reaches a selected point. The blower has a central shaft part and blades extending radially outwardly from the shaft part.

U.S. Pat. No. 8,191,289 to Raftery discloses a skid for use on a snow blower. The snow blower includes an auger housing through which snow removed from an area is channeled. The skid includes a body that is secured to a vertical side wall of the auger housing. The body includes a sliding surface which assists the auger housing in sliding over snow-covered regions of the area being cleared; and a rolling surface which assists the auger housing to travel over snow-free regions of the area.

U.S. Patent Application Publication No. 20090307941 to Gamble discloses a plow, including a center blade and a wing blades coupled to each end of the center blade. Each wing blade is pivotally connected to the center blade about an axis.

U.S. Patent Application Publication No. 20110113657 to Mills discloses a snow deflector apparatus that easily attaches to a snowplow. The deflector apparatus includes a kit, and the snowplow system includes two snow deflectors and a control system.

U.S. Patent Application Publication No. 20120079749 to Dimario discloses a device and method of use of a plow back blade for snow removal. The plow back blade is attached to a snowplow or snow blower to assist with removing snow from areas that are otherwise difficult to access with conventional snow removal equipment. The plow back blade is rotatably attached to a snowplow blade at a pivot point.

Foreign Patent Publication No. JP2003041544 to Morimoto et al. discloses a blower for a snow plow. The blower reduces noise during work and surely discharges collected snow to a snow discharge chute. The snow discharge is effected by radially standing a plurality of blades, etc., in a blower base board and bending a tip part of each blade in the turning direction.

Foreign Patent Publication No. CA2133495 to Pedersen discloses a scraping implement that can be quickly coupled and uncoupled to a conventional self-propelled snow blower for the removal of snow from a driveway or sidewalk.

Non-Patent Literature entitled "*Unimog Snow Plow*" found at http://www.youtube.com/watch?v=oig5NGc8Qb4 (hereinafter, "the Unimog publication") discloses a Unimog 1200 and RASCO kalnik 3.0 snow plow.

Non-Patent Literature entitled "*Crafts Manual-Stage Snow Blower Tractor Attachment*" found at http://www.searsoutlet.com/d/product_details.jsp?pid=41354&mode=buyUsedOnly&sid=IDx20110411x000008&cisku=8797230&ci_gpa=pla&ci_kw={keyword} (hereinafter, "the 'Crafts publication") discloses a dual-stage snow blower tractor attachment. The dual-stage snow blower tractor attachment is connected to a lawn tractor type device. It is appointed to throw snow in a 25-40 foot parabolic arc. When attached to a tractor, the dual-stage snow blower tractor attachment cuts through piles of snow, ice and slush that leave even the plow trucks stranded. The device includes easy-to-use arm flaps for control of the snow blower, adjusting throw, pitch and height to lay that snow down exactly where the user wants it.

Notwithstanding the efforts of prior art workers there remains a need in the art for a snow plow-blower apparatus adapted to be used in operation with a vehicle to plow and remove snow, wherein the blower and/plow function can operate unilaterally or in conjunction with one another. Further, there exists a need in the art for a snow plow-blower apparatus wherein blades are provided for closing the snow-blower orifice when not needed. Additionally, there exists a need in the art for a snow plow-blower apparatus having the ability to direct snow as needed to prevent clogging and/or jamming of the apparatus.

SUMMARY OF THE INVENTION

The present invention provides a snow plow-blower apparatus that is especially well suited for use in operation with a land vehicle to plow and remove snow. The blower and/plow function can be realized unilaterally or in conjunction with one another. Advantageously, the blower can be covered to prevent snow ingress when the blower is not being utilized. Secondary blades associated with the snow plow-blower direct snow as needed to mitigate and/or prevent clogging, unwanted snow distribution and/or snow pile placement.

The snow plow-blower apparatus comprises, in combination, a plow head blade having scoop wings located on opposing side walls thereof. The scoop wings are retractable and/or have pivot means. The snow plow-blower plow head blade includes a cavity having an aperture with blower doors. The cavity includes a snow blower unit housed therein. The snow blower unit comprises at least one auger for moving snow within the cavity and at least one impeller in communication with a power source adapted to move the snow into the unit and force it out of a discharge chute. The blower doors are adapted to move into close and open configurations.

The blower doors are provided over the snow blower unit cavity to prevent snow from entering into the cavity when the blower is off. Optionally, the blower doors move along a track and rest flush against the plow head to open and close. Alternatively, the blower doors are hingedly mounted to pivot to open and closed positions. The blower doors may be constructed to operate as blower blades to direct snow into the blower unit; alternatively, separate blower blades are provided to optimize snow removal and mitigate jamming/clogging.

In one embodiment, tracks are located on the blade head perpendicular and proximate to the blower doors. Moving along the track, the blower doors are adapted to slide into open and closed configurations that open and close the aperture of the cavity. Preferably, the tracks are flush against the blade head so that the blower doors lay substantially flat there against. The blower doors may further comprise a hinged joint so that the doors are adapted to pivot open to form blades positioned to channel snow into the aperture of the cavity and the blower unit. Alternatively, separate blades may be provided proximate and adjacent to the blower doors.

In another embodiment, the snow blower doors further comprise a hinged joint. With this arrangement, the doors are adapted to pivot open to form blades appointed to channel snow into the aperture of the cavity and the blower unit.

Preferably the cavity having the aperture with the blower doors is located substantially centrally along the plow head blade.

The blower unit of the snow plow-blower apparatus is appointed to be powered by an engine of a vehicle via hydraulic hook-up to the vehicle or tractor. Alternatively, the snow plow-blower apparatus includes a blower engine integrated within the blower unit for powering the snow blower unit. Horsepower of the blower engine may vary according to the commercial size/requirements necessary. For example, for a commercial or municipality commercial grade device, the blower engine should be of a sufficient horsepower to accommodate large projects. Different geographical areas will further require greater horsepower to address the snow fall and accumulation specifics for a region. For residential devices, a lower horsepower may be used. Though the device herein is discussed in terms of attachment to a vehicle such as a truck, bulldozer or tractor, the device may be of such a size and construct so that it can be readily attached to a small tractor or lawn mower for residential snow removal.

The scoop wings preferably retract or pivot behind the plow head blade when the wings are disengaged, no longer needed, or when the blade needs to be of a shorter diameter to fit into smaller plowing areas (i.e. small driveways, parking lots, etc.). Preferably, the scoop wings are on pivot hinges, wherein the hinges provide pivot of at least 90 degrees in front of the plow head blade and at least 90 degrees behind the plow head blade. Optimally, the scoop wings each have separate wing controls so that each can be pivoted separately. With this arrangement, each of the scoop wings can be adjusted to different angles and degrees in relation to one another and in relation to the plow head blade.

The blower blades (or blower doors depending on the embodiment) are on pivot hinges, so that the hinges provide pivot of at least 180 degrees in front of the plow head blade. Like the scoop wings, the blower blades each have separate blower blade controls so that they can be pivoted separately. In this manner, the blower blades can be adjusted to different angles and degrees in relation to one another and in relation to the blower unit and the plow head blade.

In another embodiment, a snow plow-blower apparatus, comprising (i) a plow head blade, and (ii) a blower unit having a long hollow or solid double steel serrated auger, with single or multiple impellar discharge systems inside the blower unit and at least one chute, is provided. In this embodiment, the plow head blade moves vertically upward exposing the blower unit.

BRIEF DESCRIPTION OF THE DRAWINGS

The invention will be more fully understood and further advantages will become apparent when reference is made to the following detailed description of the preferred embodiments of the invention and the accompanying drawing, in which.

DETAILED DESCRIPTION OF THE INVENTION

Figure 1:
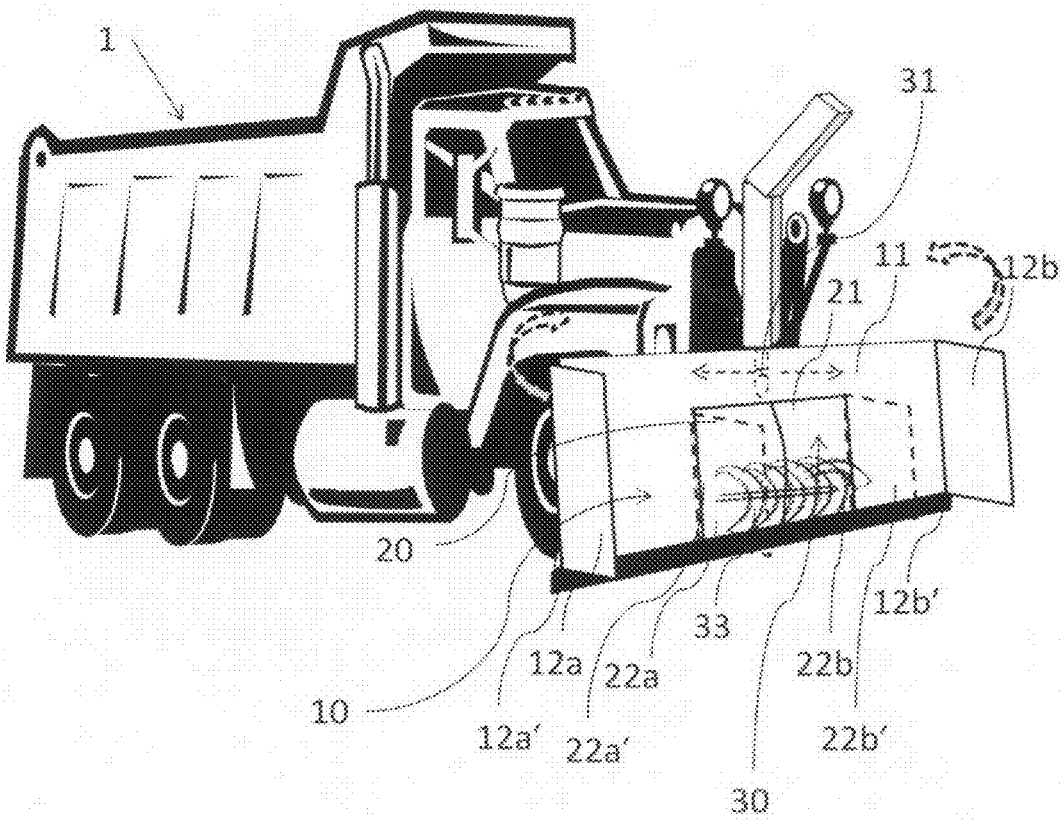
FIG. 1 illustrates a schematic view of the snow plow-blower attached to a vehicle.

A snow plow-blower device operating as a snow plow, snow blower, or as a snow plow-blower combination is provided. The device comprises a plow head blade having retractable/pivotal scoop wings and a cavity having an aperture with blower doors and a blower unit. The snow blower unit includes impeller to move snow into the unit and force it out of a discharge chute. Preferably, the snow blower unit further includes at least one auger, and a heating device is preferably also provided. The heating device may comprise a heat coil/element, placed strategically on or within an augers surface area in an effort to prevent packing and freezing of snow build up. Blower doors are provided over the snow blower unit cavity to prevent snow from entering into the cavity when the blower is off. Optionally, the blower doors move along a track and rest flush against the plow head to open and close. Alternatively, the blower doors are hingedly mounted to pivot to open and closed positions. The blower doors may be constructed to operate as blower blades to direct snow into the blower unit; alternatively, separate blower blades are provided to optimize snow removal and mitigate jamming/clogging.

Current snow plow devices suffer from problems, including, a propensity to frequent jamming and requiring significant manual labor when switching from plow to blower functionality as they require mechanical replacement of a plow blade with a blower unit. Also current devices fail provide the ability to utilize both functions independently or contemporaneously as needed. Safety issues, as well as operational issues result owing to the jamming and clogging, as a jamming condition often requires the operator to dismount from the vehicle and attempt to address the jam. Each year there are thousands of snow blower related injuries which require medical attention. One problem with the design of current snow blowers is that snow can build up in the auger, causing it to jam and stall the motor. Deformation of the auger often results if the motor is not stalled.

Currently known and utilized devices are prone to jamming owing to the location of the snow blower in relation to the plow head. Often, the snow blower unit is located on the side of the snowplow blade wherein the snow is being plowed toward the blower unit which must operate quickly enough to throw the snow. If the blower is not operating quickly enough, snow begins to rapidly build-up against the blower, causing it to jam, rendering an unsafe condition and/or damage to the snow blower portion of the device. Further, several devices require either mounting a snow plow blade apparatus or a snow blower apparatus add-on to a device, and as a result, the operator must manually mount the requisite structure desired. Thus the operator cannot simultaneously use the two functions in conjunction with one another and significant down time is required to perform the conversion from one function to the other.

The present invention provides a snow plow-blower apparatus adapted to be used in operation with a land vehicle to plow and remove snow. Functionality of the blower and/plow can operate unilaterally or in conjunction with one another. Advantageously, the blower can be covered to prevent snow ingress when the blower is not being utilized. Additionally, the subject snow plow-blower apparatus provides secondary blades for directing snow as needed to mitigate and/or prevent clogging, unwanted snow distribution and/or snow pile placement.

The snow plow-blower apparatus comprises, in combination, a plow head blade which may include scoop wings located on opposing side walls of the plow head blade. The optional scoop wings are preferably retractable and/or have pivot means. The snow plow-blower plow head blade includes a cavity having an aperture with blower doors. In one embodiment the cavity is an opening directly leading to the auger for snow removal; in another embodiment the cavity is a sealed chamber whereby a vacuum system of snow removal can be employed with some minor engineering changes and optional parts.

The cavity includes a snow blower unit housed therein. The cavity may, or may not be a sealed chamber whereby a vacuum system of snow removal can be employed with some minor engineering changes and optional parts. The snow blower unit comprises at least one auger in communication with a power source adapted to move the snow into the unit and force it out of a discharge chute. Alternatively, the chute may rotate up to 360° (degrees) that permits the blowing of snow directly into the truck the device is mounted to as well as forward and adjacent trucks riding along the road during removal operations.

The blower doors are adapted to move into closed and open configurations. The blower doors are positioned over the snow blower unit cavity to prevent snow from entering into the cavity when the blower is off Optionally, the blower doors move along a track and rest flush against the plow head to open and close. Alternatively, the blower doors are hingedly mounted to pivot to open and closed positions. The blower doors may be constructed to operate as blower blades to direct snow into the blower unit; alternatively, separate blower blades are provided to optimize snow removal and mitigate jamming/clogging.

In one embodiment, tracks are located on the blade head perpendicular and proximate to the blower doors. Moving along the track, the blower doors are adapted to provide open and closed configurations to open and close the aperture of the cavity. Preferably, the tracks are flush against the blade head so that the blower doors lay substantially flat or flush against the blade head. The blower doors may further comprise a hinged joint so that the doors are adapted to pivot open to form blades appointed to channel snow into the aperture of the cavity and the blower unit. Alternatively, separate blades may be provided proximate and adjacent to the blower doors.

In another embodiment, the snow blower doors further comprise a hinged joint so that the doors are adapted to pivot open to form blades appointed to channel snow into the aperture of the cavity and the blower unit.

Preferably the cavity having the aperture with the blower doors is located substantially centrally along the plow head blade.

The blower unit of the snow plow-blower apparatus is appointed to be powered by an engine of a vehicle via hydraulic hook-up to the vehicle or tractor. Alternatively, the snow plow-blower apparatus includes a blower engine integrated within the blower unit for powering the snow blower unit. Power for the device isn't limited only to Hydraulic power, but can, and may be utilized using one or many forms of energy transfer, or power. The energy transfer, or delivery of power can be obtained by the employment of Pneumatic (air/fluid) Power, Internal Combustion Engine Power (i.e., gasoline, diesel, bio-diesel, natural gas, and/or hybrid engines), Mechanical Energy (direct physical linkage) Power, Chemical Energy Power, and/or Electromagnetic Energy Power. Horsepower of the blower engine may vary according to the commercial size/requirements necessary. For example, for a commercial or municipality commercial grade device, the blower engine should be of a sufficient horsepower to accommodate large projects. Different geographical areas will further require greater horsepower to address the snow fall and accumulation specifics for a region. For residential devices, a lower horsepower may be used.

Though the device herein is discussed in terms of attachment to a vehicle, such as a truck, bulldozer or tractor, it should be understood that this device may be adaptable to fit on to other machines and/or vehicles (large and small); such as lawnmowers (i.e., Toro, Honda, Craftsman), quad-off road-vehicles, utility sidewalk traveling vehicles, winter service vehicles, railcars and trains, skid-steer (i.e., bobcat), backhoes, backhoe-loader, backhoe-loader-tractor, Pay loaders and Front end-loaders (i.e., Caterpillar), or any combination of large or small earth moving type equipment, i.e., tractors and bulldozers. Accordingly, the device may be of such a size and construct so that it can be readily attached to a small tractor or lawn mower for residential snow removal.

The scoop wings preferably retract or pivot behind the plow head blade when the wings are disengaged, no longer needed, or when the blade needs to be of a shorter diameter to fit into smaller plowing areas (i.e. small driveways, parking lots, and the like). Preferably, the scoop wings are on pivot hinges, wherein the hinges provide pivot of at least 90 degrees in front of the plow head blade and at least 90 degrees behind the plow head blade. Optimally, the scoop wings each have separate wing controls so that each can be pivoted separately. With this arrangement, each of the scoop wings can be adjusted to different angles and degrees in relation to one another and in relation to the plow head blade.

The blower blades (or blower doors depending on the embodiment) are on pivot hinges. These pivot hinges provide a pivot range of at least 180 degrees in front of the plow head blade. Like the scoop wings, the blower blades each have separate blower blade controls so that they can be pivoted separately. In this manner, the blower blades can be adjusted to different angles and degrees in relation to one another and in relation to the blower unit and the plow head blade.

Figure 2:
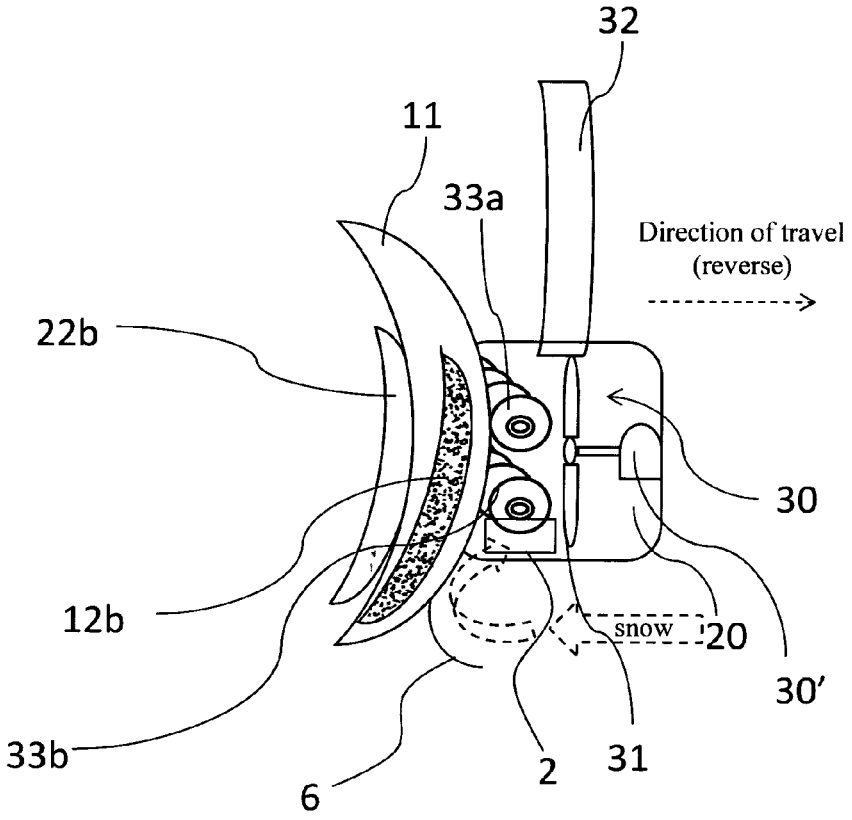
FIG. 2 illustrates a cross-sectional side view of the snow plow-blower.
Figure 3A:
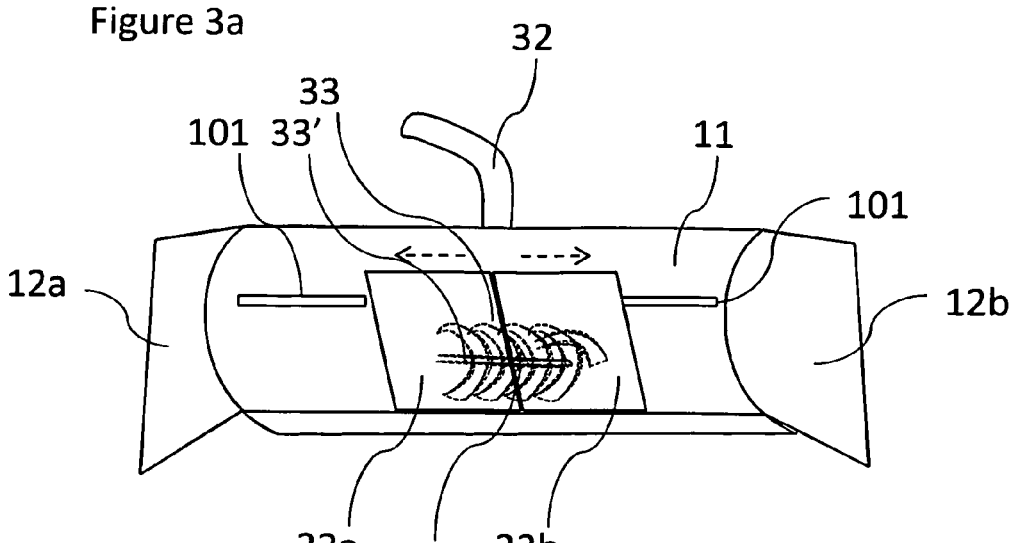
FIG. 3*a* shows a plane view of an embodiment of the snow plow-blower apparatus wherein the scoop wings are in the open configuration and the blower doors are in the closed configuration and are on tracks for opening and closing.
Figure 3B:
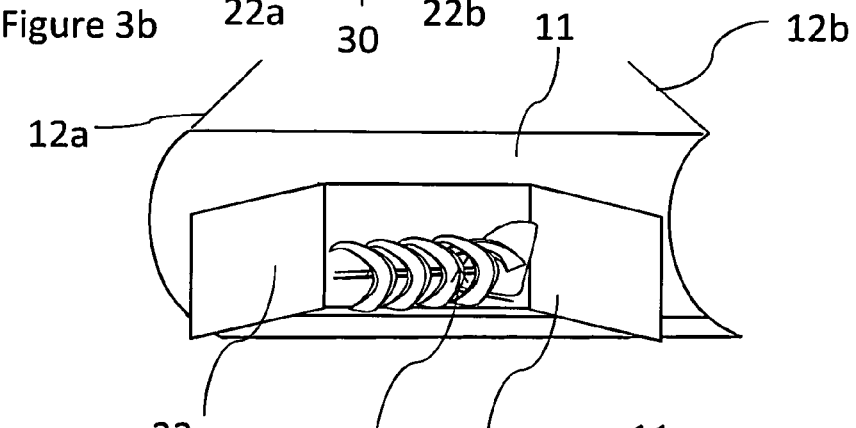
FIG. 3*b* shows an embodiment of the snow plow-blower apparatus wherein the scoop wings are in the retracted position and the blower doors are in the open configuration via a pivot mechanism so that blower doors act as blades channeling snow into the blower unit.
Figure 3C:
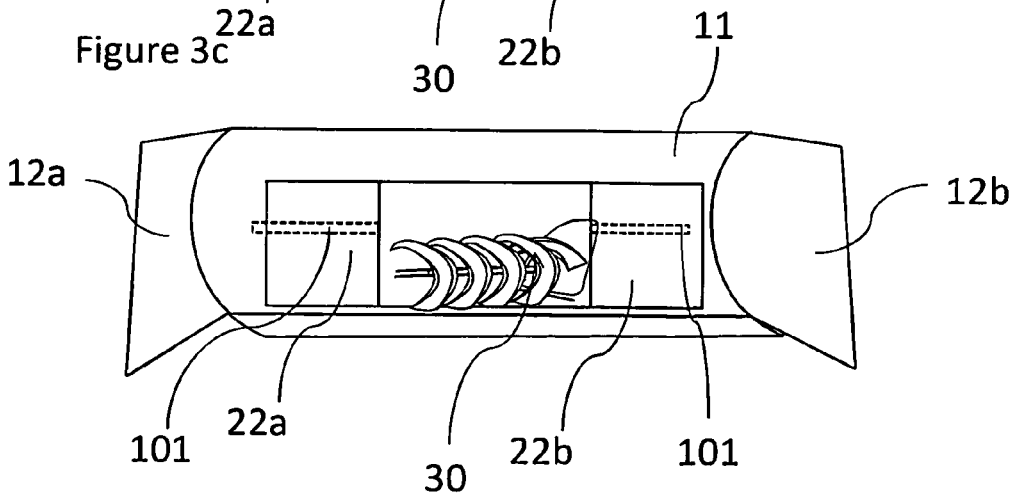
FIG. 3*c* shows the snow plow-blower apparatus wherein the scoop wings are in the open configuration and the blower doors are in the open configuration and are on tracks for opening and closing.

The enclosed figures provide illustrations of the subject snow plow-blower apparatus. FIG. 1 is a schematic view of the snow plow-blower attached to a vehicle; FIG. 2 illustrates a cross-sectional side view of the snow plow-blower; FIGS. 3*a*-3*c* illustrate plane views of an embodiment of the snow plow-blower; FIG. 4 shows a top view of the snow plow-blower, and non-skid plate jack kickstand devices, and a slip-on wheel plate; FIG. 5 shows a view of the control; and FIGS. 6*a*-6*d* illustrate schematic views of an embodiment of the snow plow-blower of the subject invention.

Referring to FIGS. 1-6, there is shown generally in FIG. 1, a snow plow-blower apparatus 10 of the present invention mounted on a vehicle 1. The snow plow-blower apparatus 10 generally includes a plow head blade 11 having scoop wings 12*a*, 12*b* located on opposing side walls of plow head blade 11. Preferably, scoop wings 12*a*, 12*b* are retractable and/or pivot along an axis 12*a*', 12*b*' on the side walls of plow head blade 11 so that the scoop wings 12*a*, 12*b* are disengaged from the scoop position. Wherein the scoop wings 12*a*, 12*b* are retractable, the plow head blade 11 includes an inner cavity and track wherein the scoop wings travel on the inner track into the inner cavity (see FIGS. 6*a*-6*b*).

The plow head blade 11 of the snow plow-blower apparatus 10 further includes a cavity 20 having an aperture 21 with blower doors 22*a*, 22*b*. Cavity 20 includes a snow blower unit 30 housed therein. As illustrated in the cross-sectional side view of the snow plow-blower of FIG. 2, a back blade 6 is located behind plow head blade 11. A horizontally mounted door 2 is located near the back blade 6 that slides open to expose cavity 20. The back blade 6 is adapted to direct snow simultaneously while operating the snow blower unit 30 and plowing in reverse, contemplated for use in situations such as against a garage door. Snow blower unit 30 generally comprises at least one auger 33 and at least one impeller 31 to move the snow into the unit 30 and force it out of a discharge chute 32, respectively. Preferably, there are two augers as shown, including a top auger 33*a* and a bottom or lower auger 33*b*. Generally, the top auger 33*a* operates as a deep snow auger while the bottom or lower auger 33*b* operates as a typical snow auger. Preferably, a separate power switch is provided on the operation panel so the user can designate use of just a single auger 33 or both augers 33*a* and 33*b*. A heating element 33' (shown in FIG. 3*a*) may be provided, preferably as a wire associated with the auger, such as within the auger tube element's body.

The blower unit 30 is generally powered by the engine of vehicle 1, via hydraulic coupling; blower unit 30 may include an engine having a variety of horsepower—i.e. less than or over 1000 horsepower (746 kW). The device isn't limited only to Hydraulic power, but can, and may be utilized using one or many forms of energy transfer, or power. The energy transfer, or delivery of power can be obtained by the employment of Pneumatic (air/fluid) Power, Internal Combustion Engine Power (i.e., gasoline, diesel, bio-diesel, natural gas, and/or hybrid engines), Mechanical Energy (direct physical linkage) Power, Chemical Energy Power, and/or Electromagnetic Energy Power. In FIG. 1, blower doors 22*a*, 22*b* are shown in the closed configuration. Phantom doors 22*a*', 22*b*' are shown in an open condition. In this open condition embodiment, doors 22*a*', 22*b*' act as blades channeling snow into blower unit 30. In another embodiment (see FIG. 3*c* for example) doors 22*a*, 22*b* slide along a track and remain flush, or substantially flush against plow head blade 11.

Referring specifically to FIGS. 3*a* and 3*c*, there is shown in FIG. 3*a* an embodiment of the snow plow-blower apparatus 10 wherein doors 22*a*, 22*b* are in the closed configuration and scoop wings 12*a*, 12*b* are in the open configuration. In FIG. 3*a*, tracks 101 are constructed within plow head blade 11; tracks 101 are appointed to mate with tracks located on the backside of doors 22*a* and 22*b* (not shown) so that doors 22*a*, 22*b* engage with tracks 101 to slide along same to open doors 22*a*, 22*b* flush against plow head blade 11 as shown in FIG. 3*c*.

Referring specifically to FIG. 3*b*, there is shown an embodiment of the snow plow-blower apparatus 10 wherein doors 22*a*, 22*b* are in the open configuration via a pivot mechanism. In this embodiment, doors 22*a*, 22*b* act as blades channeling snow into blower unit 30. Also, in FIG. 3*b*, scoop wings 12*a*, 12*b* are in the retracted position.

Figure 4A:
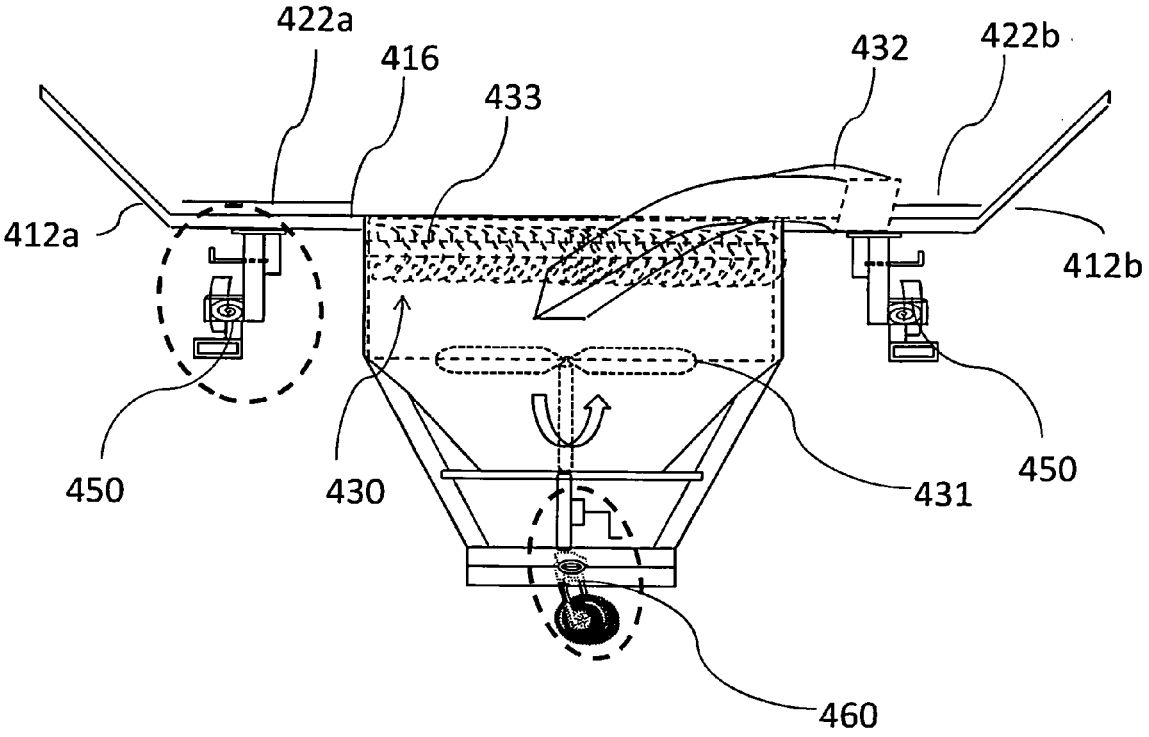
FIG. 4*a* shows a top view of the snow plow-blower apparatus wherein the blower doors are in the open configuration via a pivot mechanism so that blower doors act as blades channeling snow into the blower unit, the scoop wings are shown in the retracted position.
Figure 4B:
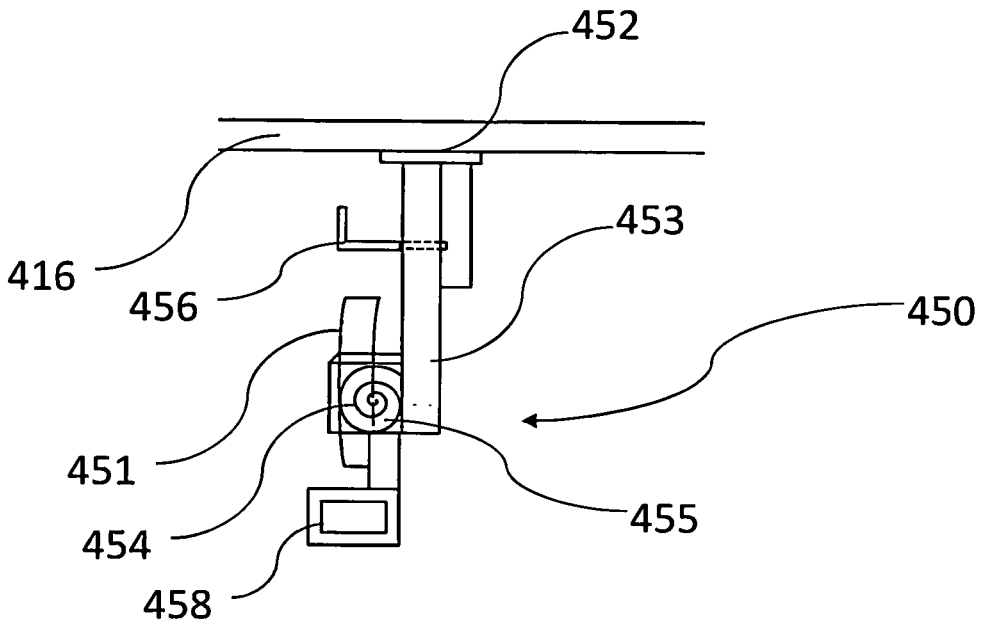
FIG. 4*b* illustrates a view of a piston or jack apparatus that may act as a kickstand type feature for the device including a non-skid plate, showing the kickstand in the upward position as when the plow blade is in use.
Figure 4C:
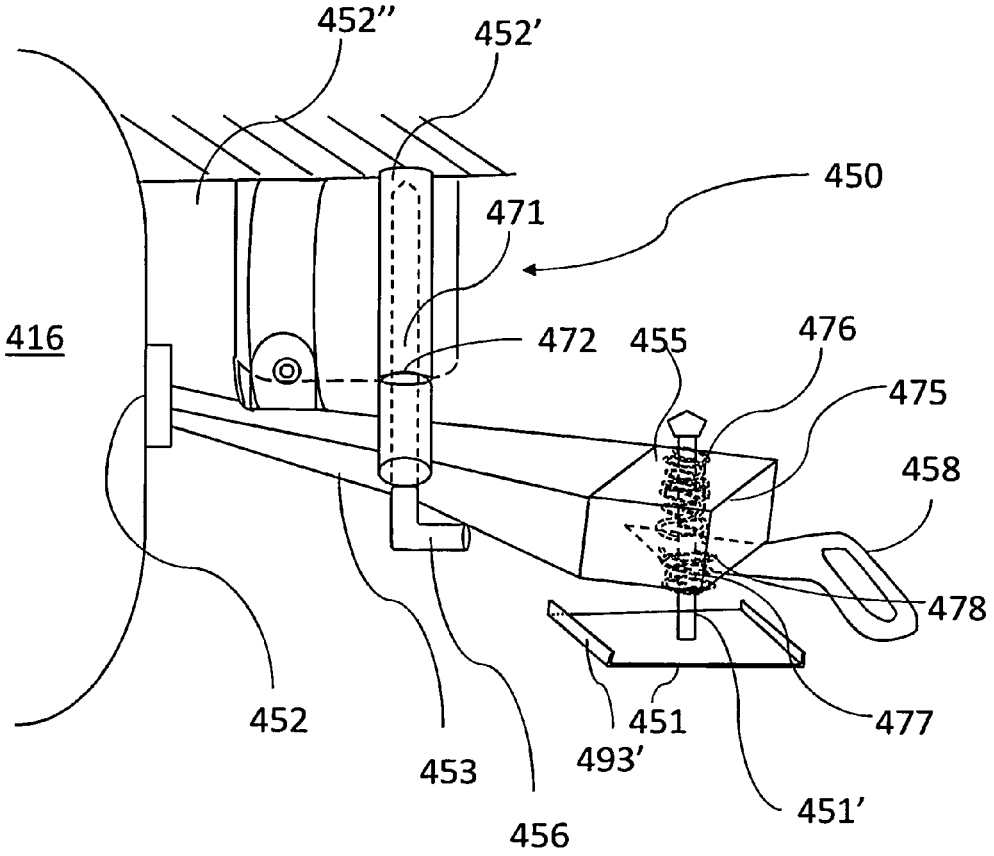
FIG. 4*c* illustrates a view of a piston or jack apparatus pivoted to the downward position engaging with the surface for stabilizing the plow blade when it is no longer in use and no longer attached to the plowing device.
Figure 4D:
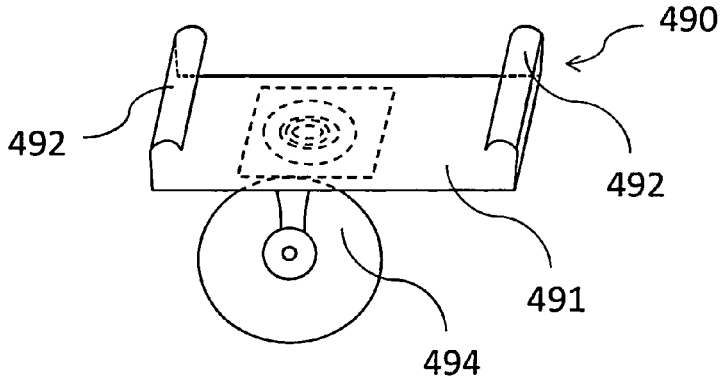
FIG. 4*d* illustrates a view of a slip-on shoe for the non-skid plate of the jack kickstand wherein the slip-on shoe includes a wheel mounted thereon.

Referring specifically to FIGS. 4*a*-4*e*, in these figures there is shown views of another embodiment of the snow plow-blower apparatus. In FIG. 4*a*, there is shown a top view of the snow plow-blower apparatus 410 wherein doors 422*a*, 422*b* are in the open configuration via a pivot mechanism. The doors 422*a*, 422*b* act as blades channeling snow into blower unit 430 and optional scoop wings 412*a*, 412*b* are in the retracted position. The embodiment of FIG. 4*a* further includes optional piston and/or jack support apparatus as shown at 450. FIG. 4*b* illustrates a view of the apparatus 450 which, as shown, includes a non-skid plate 451. The apparatus 450 is preferably a spring activated kickstand device including non-skid plate 451 or alternatively, non-skid plate 451 may be a wheel structure instead of a plate, or may include a slip-on wheel structure as shown in FIG. 4*d*. FIG. 4*b* illustrates the kickstand apparatus 450 in the upward position as when the plow blade is in use. FIG. 4*c* illustrates a view of a piston or jack kickstand apparatus 450 side profile. Specifically, this image shows the double-spring loaded kickstand mechanism at the junction point where apparatus 455 connects to 451, otherwise known as a step on spring activated feature.

Apparatus 451 is shown in FIG. 4*c* adjusted to the downward position engaging with the surface for stabilizing the plow blade when it is no longer in use and no longer attached to the plowing device. Kickstand apparatus 451 includes a support 452 via a steel and stop angle weld onto the snow-plow blade 416 for attaching the kickstand 451 to the snow-plow blade 416. Kickstand apparatus 451 is further attached to the blow box herein shown at 452" via a kickstand steel tubing frame constraint 452' welded to the left and right blower box wall. A rotating shaft 471 is provided along with connect/disconnect point 472 operable via pin 456. Support 452 is attached to an arm 453 that terminates at a spring box 475 having a top and bottom spring, 476 and 477, housed therein. A spring release handle 458 is provided wherein handle extends within the spring box 475 and terminates at a handle plate 478 located between the top and bottom springs, 476, 477, respectively. Top spring 476 is located above handle plate 478, while bottom spring 477 is located below handle plate 478. In this manner, when top spring 476 is compressed (coiled), bottom spring 477 decompresses (uncoils) and presses handle plate 478 upward and in turn moves the plate 451 via rod 451' upward. When top spring 476 is decompressed (uncoiled), bottom spring 477 compresses (coils) and handle plate 478 moves downward and in turn moves the plate 451 via rod 451' downward.

Plate 451 is preferably structured as a steel plate/ski that is appointed to received within a slip-on shoe with a wheel such as illustrated in FIG. 4*d*, shown generally at 490. Slip-on shoe generally includes a plate 491 having curved edge walls 492 and a wheel structure 494 mounted there under. Curved edge walls 492 are structured to receive side walls 493' of plate 451. Wheel structure 494 is preferably a hard wheel mounted to a rotating caster frame welded to plate 491.

Figure 4E:
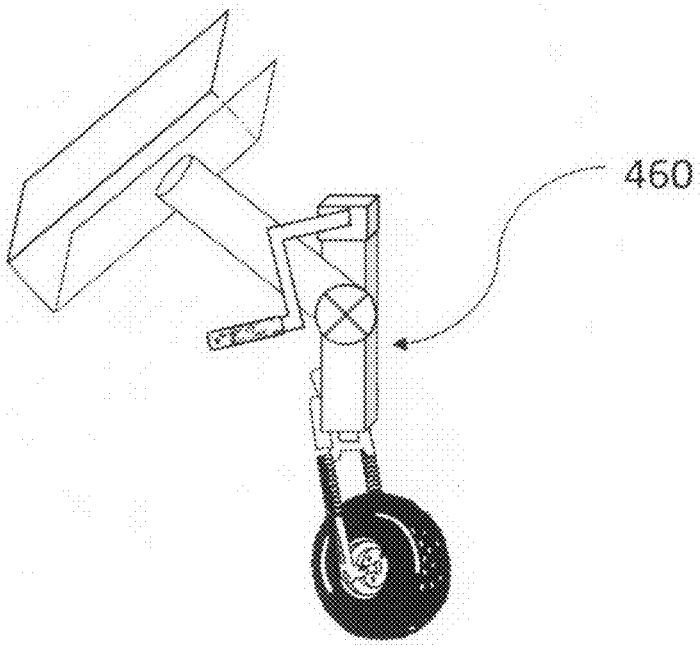
FIG. 4*e* illustrates a view of a pivotal wheel support structure which may be provided for easy movement of the device when disconnected from a vehicle.
Figure 5:
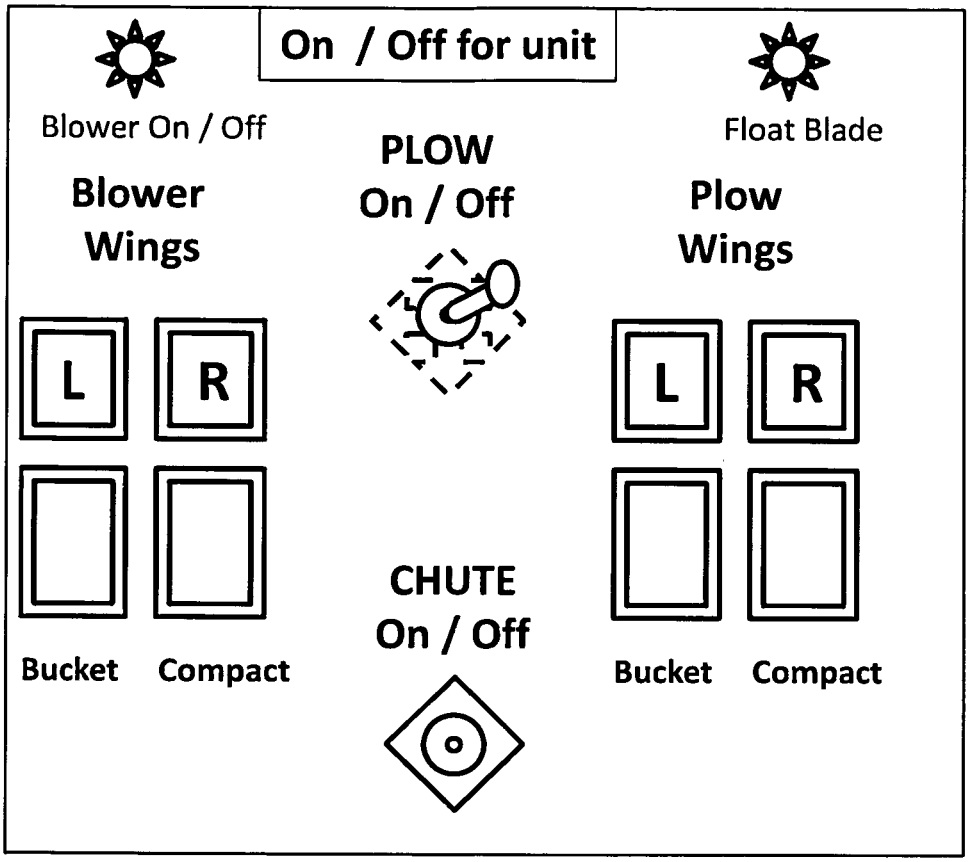
FIG. 5 illustrates a control panel for the snow plow-blower device.

FIG. 4*e* illustrates a view of a pivotal wheel support structure 460 operable via a jack handle and jack assembly which may be provided for easy movement of the device when disconnected from a vehicle. Preferably, wheel support structure 460 is located substantially centrally as shown. Release is achieved through stepping on handle 458 after removing pin 456. As the user steps on the handle 458 the leg 455 is lowered. In turn, to return the kickstand to the upward position, the handle 458 is pulled upward and the leg 455 pivots upward. In operation the pull pin 456 is removed and the leg is moved from horizontal to vertical position, and vise versa. It is noted that the blade would have to be in a raised position to release the pin. The kick stand is strucutred as a piston and jack so that when on uneven plane, the blade can be adjusted accordign to the ground surface. Skid plate 451 is preferably structured as a flat plate. Skid plate 451 may instead be structured as a wheel.

FIG. 5 illustrates a control panel for the snow plow-blower device. The control panel may be hard wired; or optionally, the panel may be wireless. Preferably, control is provided individually for each of the left and right blower wings (doors) and blade wings/scoop wings, "Bucket" button provides for both left and right blower wings (doors) and both blade wings/scoop wings to move in the open position. "Compact" button provides for both left and right blower wings (door) and both blade wings/scoop wings to move in the closed position. A "Float" button is provided for moving the blade in the air when driving. Press door buttons, left or right-option to open both doors or one door and indicator light goes on. The device provides for the ability to only open one of the left or right blower wings (doors); and for the ability to open only the left or right blade wings/scoop wings. Preferably, the blower blades or blower wings each have separate blower blade controls so that the blades can be pivoted separately, shown at 501, so that each of the blower blades can be adjusted to different angles $\alpha$ and degrees in relation to one another and in relation to the blower unit and the plow head blade.

Figure 6A:
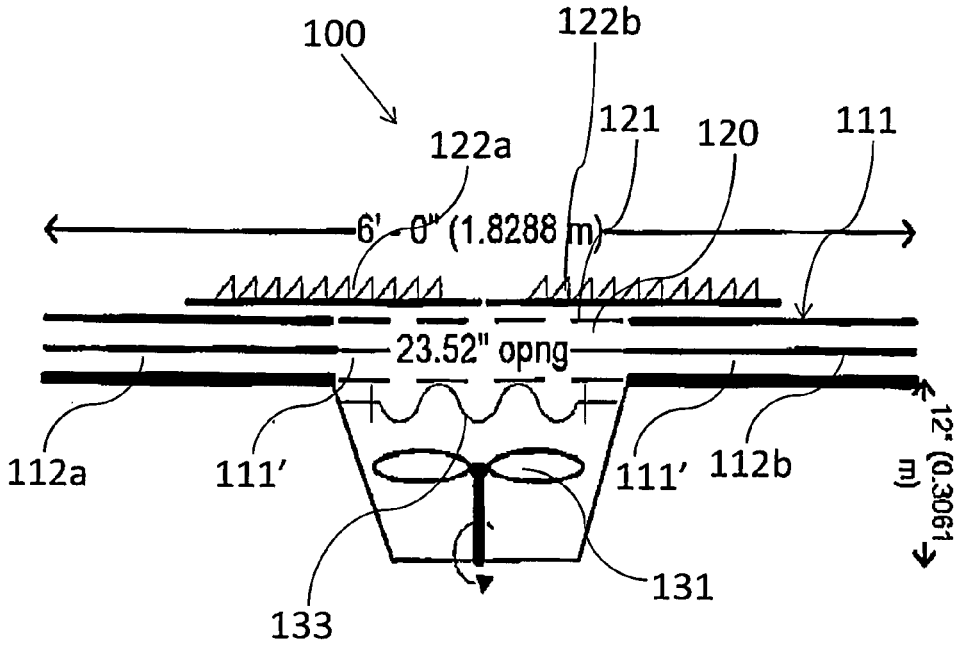
FIG. 6*a* illustrates the straight blade configuration with both the blower doors and scoop wings in the closed position.
Figure 6B:
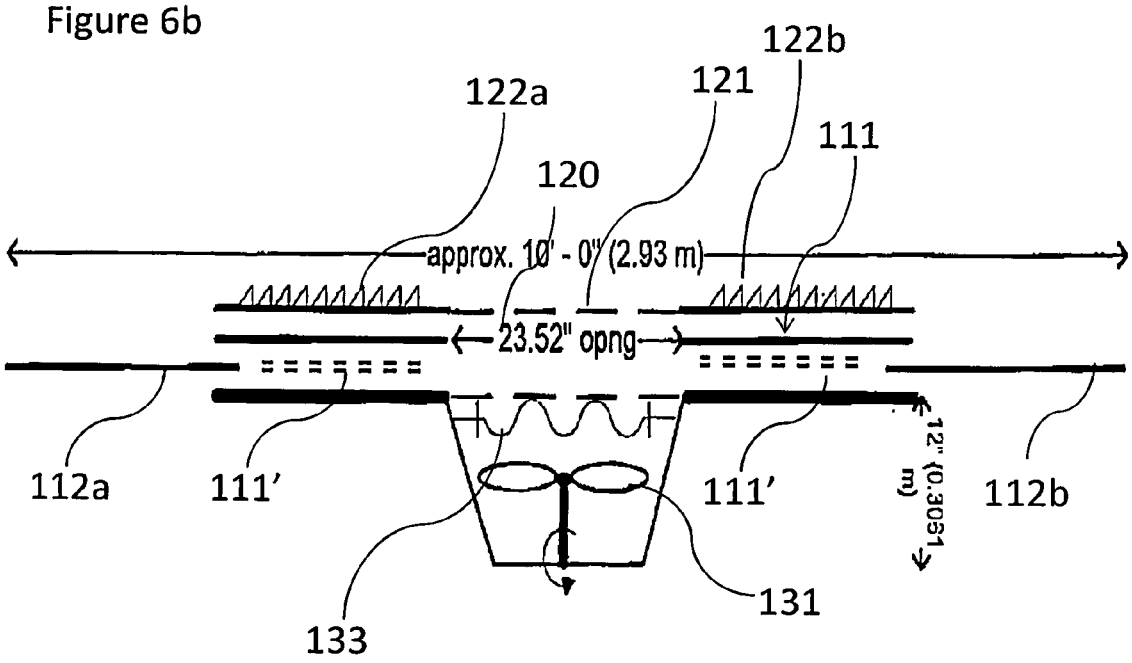
FIG. 6*b* illustrates the straight blade configuration with both the blower doors and scoop wings in the open position.
Figure 6C:
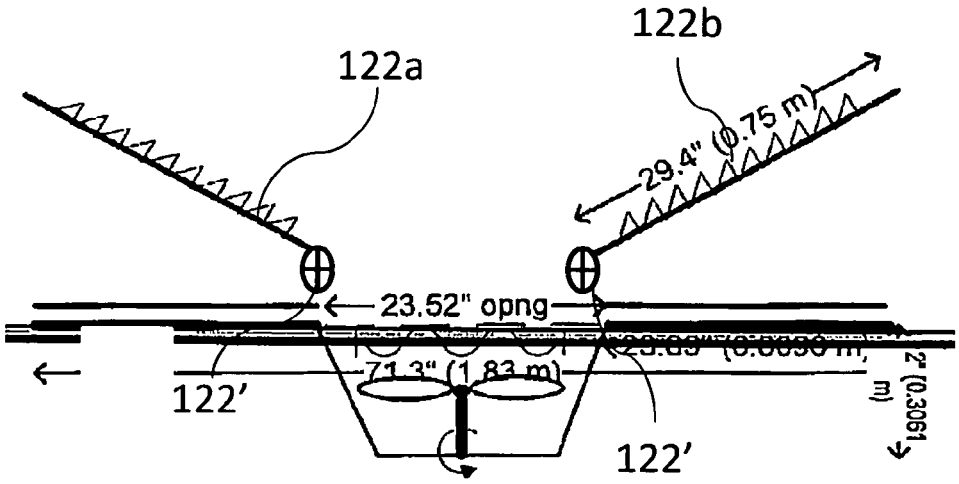
FIG. 6*c* illustrates the straight blade (scooped wings) configuration wherein the scoop wings are in the retracted position and the blower doors are pivoted in the open configuration via a pivot mechanism so that blower doors act as blades channeling snow into the blower unit.
Figure 6D:
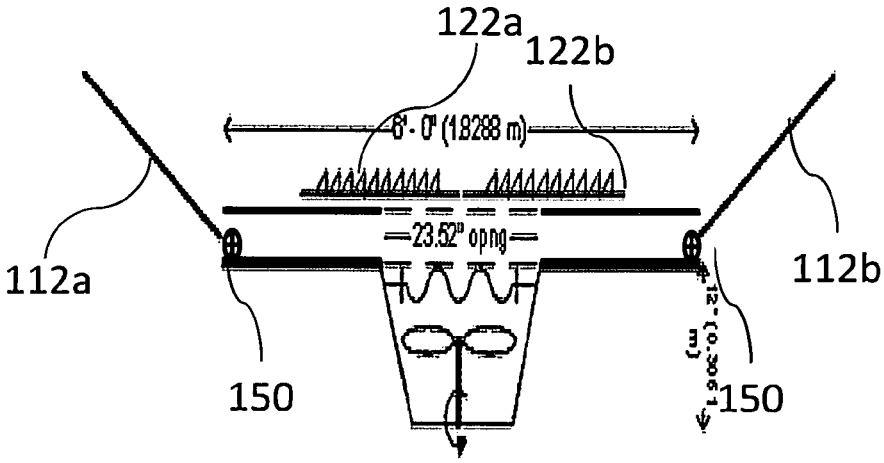
FIG. 6*d* illustrates the scooped wings closed doors configuration wherein the scoop wings are in the open configuration and the blower doors are in the closed configuration.

FIGS. 6*a*-6*d* illustrate configurations of the snow plow-blower device: wherein FIG. 6*a* shows the straight blade closed configuration. FIG. 6*b* illustrates the straight blade (open doors and wings) configuration (equivalent to FIG. 3*c*). FIG. 6*c* illustrates the straight blade (scooped wings) configuration (equivalent to FIG. 3*b*). FIG. 6*d* illustrates the scooped wings closed doors configuration (equivalent to FIG. 3*a*).

Referring to FIGS. 6*a*-6*b*, the snow plow-blower apparatus 100 generally includes a plow head blade 111 having scoop wings 112*a*, 112*b* located adjacent to opposing side walls of plow head blade 111. In the embodiment shown, scoop wings 112*a*, 112*b* are retractable within an inner cavity 111' in the plow head blade 111. Scoop wings 112*a*, 112*b* include grooves/tracks along their top and bottom edges that mate with and glide along mating tracks located on the top wall and bottom wall of the inner cavity 111'. As shown, in FIG. 6*a* the scoop wings 112*a*, 112*b* are retracted/disengaged from the scoop position. In FIG. 6*b* the scoop wings 112*a*, 112*b* are open and engaged in the scoop position for plowing.

The plow head blade 111 of the snow plow-blower apparatus further includes a cavity 120 having an aperture 121 with blower doors 122*a*, 122*b*. Cavity 120 includes a snow blower unit housed therein. Snow blower unit generally comprises at least one auger 133 and at least one impeller 131 to both move the snow into the unit and force it out of a discharge chute. In FIG. 6*a*, blower doors 122*a*, 122*b* are shown in the closed configuration. In FIG. 6*b*, blower doors 122*a*, 122*b* are shown in the open configuration running on tracks flush against the blade head 111.

Referring to FIGS. 6*c*-6*d*, the scoop wings 112*a*, 112*b* are retractable and pivotal on a hinge 150 on the side of the plow head blade 111 as illustrated in FIG. 6*d*. Blower doors 122*a*, 122*b* are also provided as pivotal at 122'.

Figure 7:
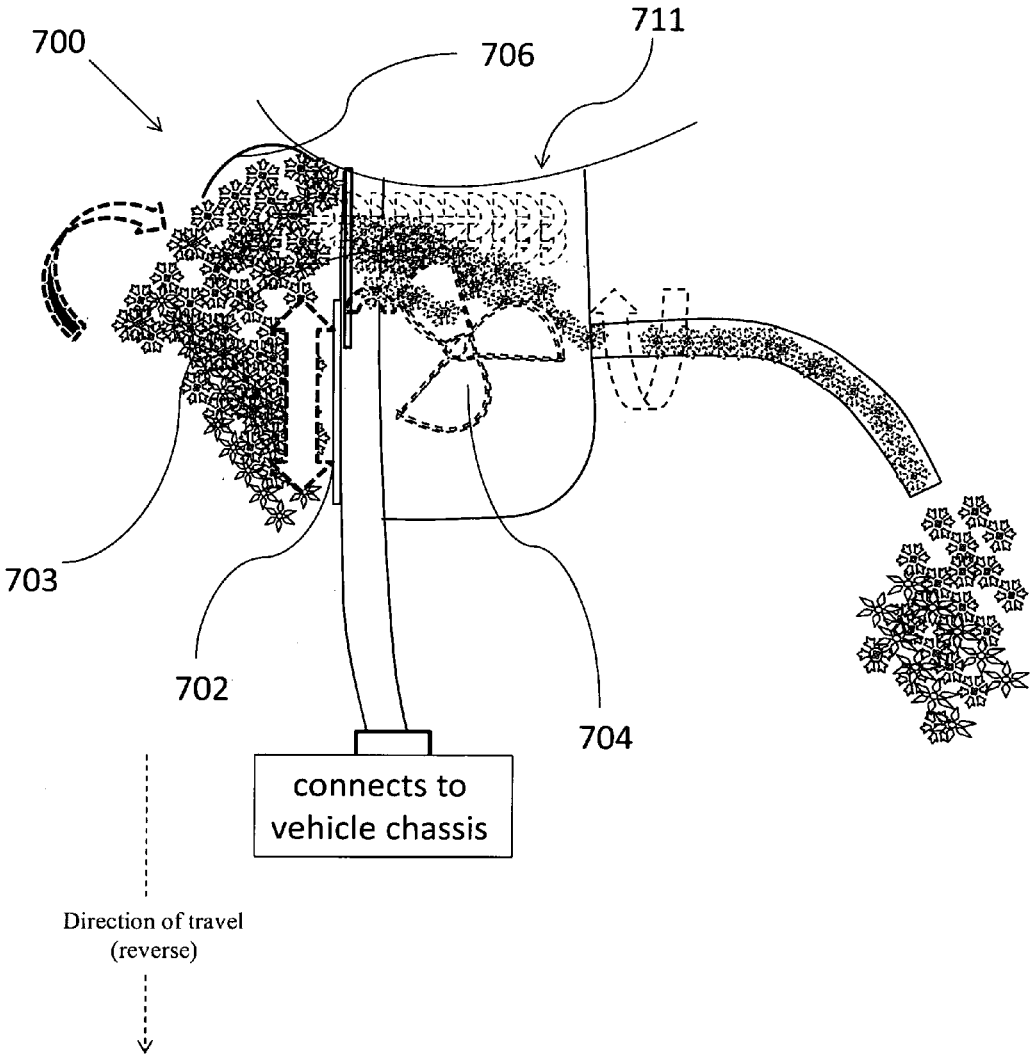
FIG. 7 illustrates another embodiment of the subject invention wherein a horizontally mounted door slides open to expose the blower box chamber above the back blade while the backblade directs at least a vehicle length worth of snow simultaneously while the operating the blower and plowing in reverse (say, against a garage door)

FIG. 7 illustrates another embodiment of the subject invention generally at 700. In this embodiment a back blade 706 is located behind plow head blade 711. A horizontally mounted door 702 is provided that slides open to expose a blower box chamber/cavity 703 having a snow blower unit 704 housed therein. The structure of the plow head blade 711 and cavity 703 are described herein above in the discussions regarding FIGS. 1-6. The back blade 706 is adapted to direct at least a vehicle length worth of snow simultaneously while operating the blower and plowing in reverse, contemplated for use in situations such as against a garage door.

Figure 8A:
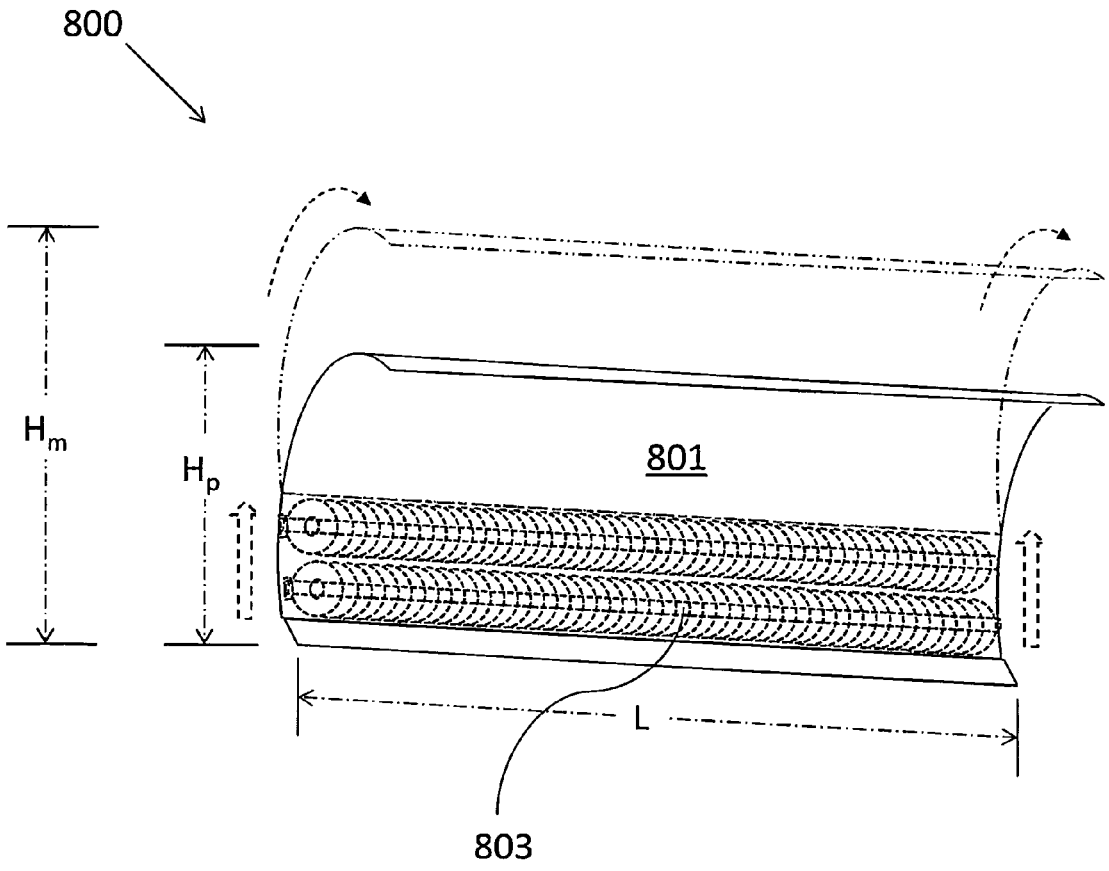
FIG. 8*a* illustrates another embodiment of the subject invention wherein a Hybrid Model/Design is provided wherein the complete plow head—end to end—moves vertically exposing a complete blower box chamber from one end of the device to the other end of the device, wherein the blade is in the closed position so that the blower box chamber is exposed.
Figure 8B:
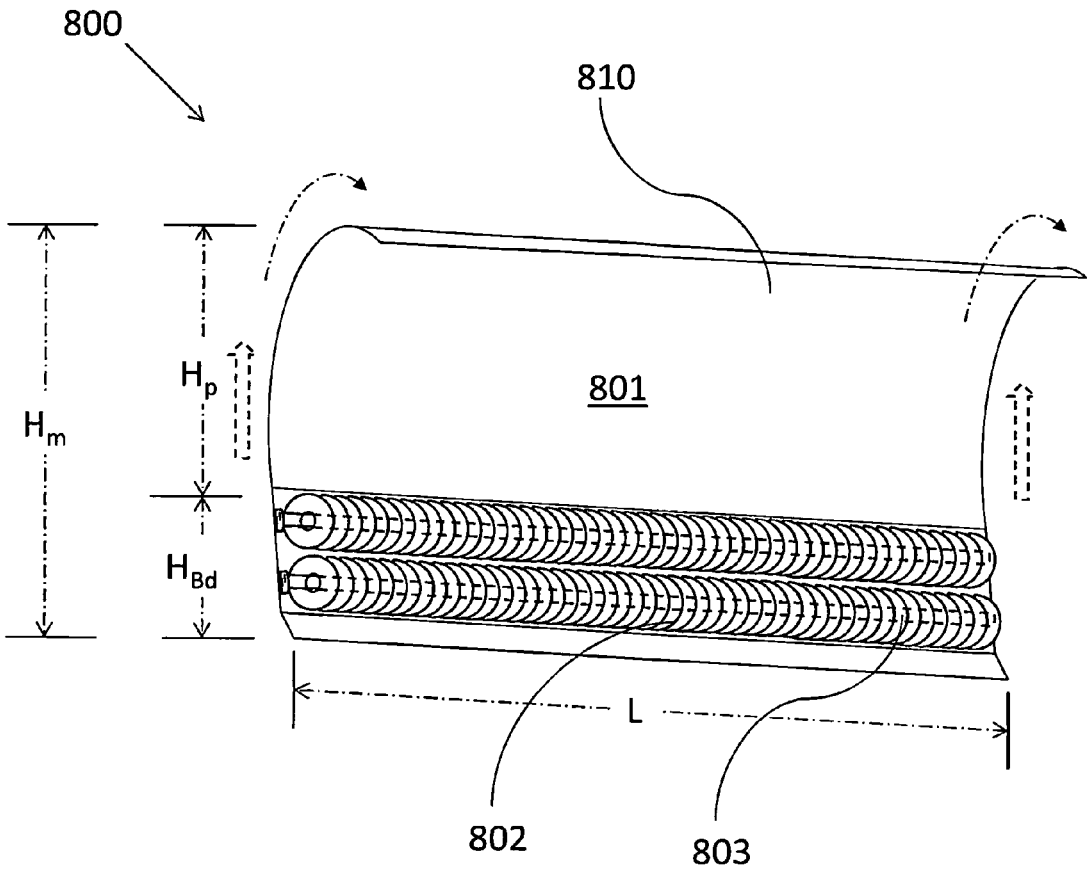
FIG. 8*b* illustrates the blade in the open or vertically upward position exposing the blower box chamber.
Figure 9:
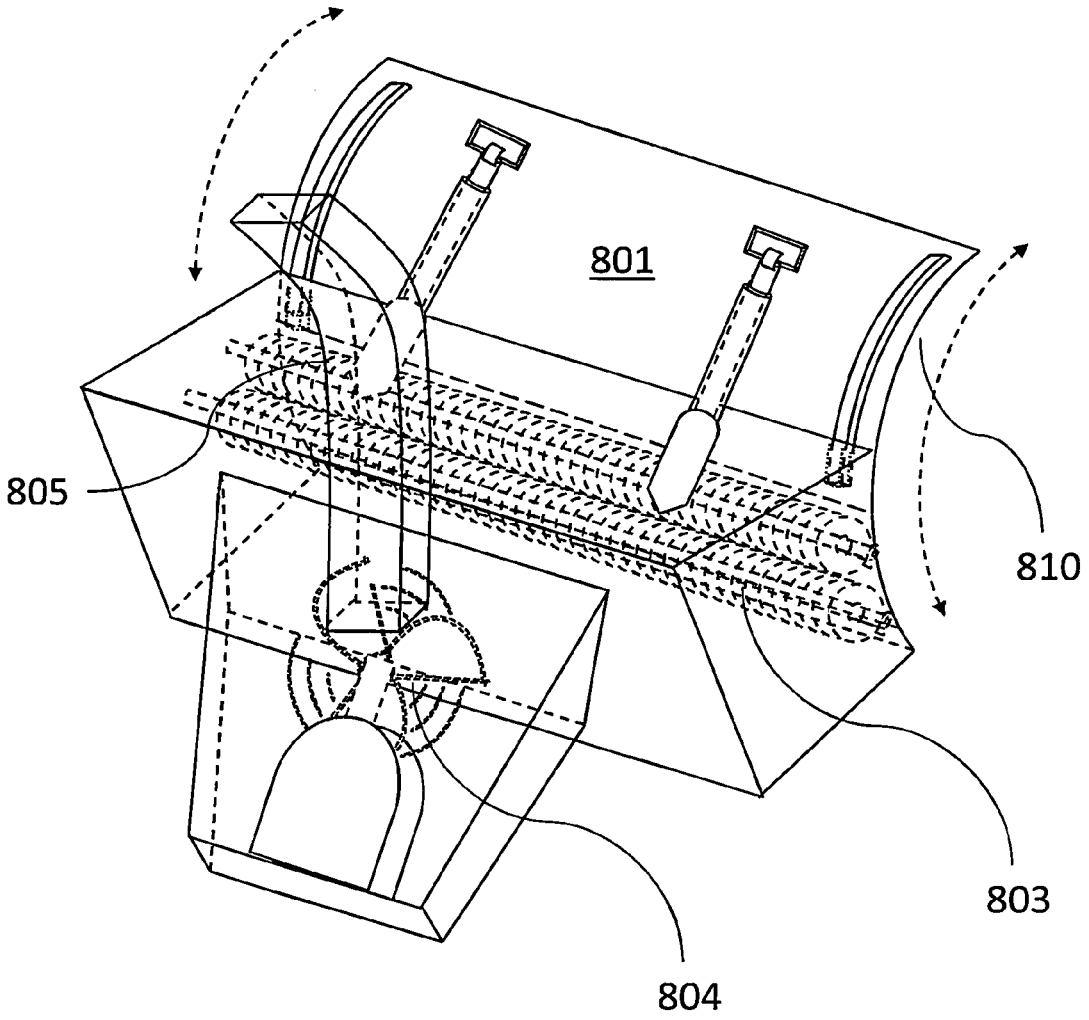
FIG. 9 illustrates a top view of the embodiment of FIG. 8*b* wherein the blade is in the open position.

FIGS. 8*a*-8*b* illustrate another embodiment of the subject invention wherein a Hybrid Model/Design 800 is provided wherein the complete plow head 801—end to end—moves vertically exposing a complete blower box chamber 802 from one end of the device to the other end of the device. In FIG. 8*a* the blade is in the closed position so that the blower box chamber is exposed; in FIG. 8*b* illustrates the blade in the open or vertically upward position exposing the blower box chamber. FIG. 9 illustrates a top view of the embodiment of FIG. 8*b* wherein the blade is in the open position.

Referring to FIGS. 8*a*-8*b* and FIG. 9, in FIG. 8*a* the plow head 801 is located in front of blower box chamber 802 in the closed position. Phantom blade is shown above in the open position. In FIG. 8*b*, plow head 801 is moved vertically upward to expose blower box chamber 802 and augers 803 therein. An impeller 804 is provided for propelling snow through a discharge chute 805. To top portion 810 of the blade plow head 801 is curved or concave in nature so that as the blade 801 moves upward it leans/or curves forward as indicated by way of the phantom arrows in FIGS. 8*a*-8*b* and FIG. 9. Accordingly, if the operator travels at max speed the curved blade/plow head 801 forces excess snow to roll off top of blade and forward again for removal via the blower box chamber 802. Optionally, the length of the blade is equal to the length of the blower box or alternatively, the blower box may be a greater length via the length of the plow blade. The plow blade preferably has the contoured shape and hydraulics to rotate the blade to channel snow into the blower (FIG. 9). As structured, the blade head leans forward to direct snow to roll forward. $H_p$ refers to the height of the plow-blade; $H_{Bd}$ refers to the height of the blower box; $H_m$ refers to the max height of the blade head in the raised position to the bottom of the device. $H_{Bd}$ preferably ranges from about 12 inches to 36 inches; preferably ranging from about 16 inches to 24 inches in height. $H_{Bd}$ may be built or sized to a variety of heights and widths for a variety of vehicle applications, extending for example from smaller units to accommodate lawn tractors and or small tractors, to larger units to accommodate heavy duty tractors, trucks, and/commercial vehicles.

In another embodiment, the cavity leads to a sealed chamber whereby a vacuum system of snow removal is adapted to be employed to remove snow therefrom. The cavity may, or may not be a sealed chamber whereby a vacuum system of snow removal can be employed with some minor engineering changes and optional parts. In another optional embodiment, the snow plow-blower apparatus includes a versatility 360° chute having a long and flexible chute, where the device also blows snow directly into a back of a truck that said snow plow-blower apparatus operator is driving and clearing a path with.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A snow plow-blower apparatus, comprising:

a. a plow head blade;

b. a cavity integrated within a portion of said plow head blade having an aperture with blower doors;

c. said cavity including a snow blower unit housed therein, said snow blower unit comprising at least one auger and impeller in communication with a power source adapted to move snow into the unit and force it out of a discharge chute;

d. said blower doors being adapted to move into closed and open configurations, wherein said blower doors move from an open to a completely closed configuration to thereby completely close said aperture of said cavity, preventing all snow ingress into said snow blower unit when said snow blower unit is not being utilized;

e. said plow head blade having scoop wings located on opposing side walls of said plow head blade and wherein said scoop wings are retractable within an inner cavity in said plow head blade moving along a track.

2. The snow plow-blower apparatus as recited by claim 1 comprising tracks located on said plow head blade being perpendicular and proximate to said blower doors, wherein said blower doors are adapted to move along said tracks to yield open and closed configurations to open and close said aperture of said cavity.

3. The snow plow-blower apparatus as recited by claim 2, wherein said tracks are flush against said plow head blade and said blower doors lay substantially flat against said plow head blade.

4. The snow plow-blower apparatus as recited by claim 2, wherein said blower doors further comprise a hinged joint so that said doors are adapted to pivot open to form blades appointed to channel snow into said aperture of said cavity and said blower unit.

5. The snow plow-blower apparatus as recited by claim 1, wherein said blower doors further comprise a hinged joint so that said doors are adapted to pivot open to form blades appointed to channel snow into said aperture of said cavity and said blower unit.

6. Said snow plow-blower apparatus as recited by claim 5, wherein said blower doors can pivot at least 180 degrees in front of said plow head blade so that said blower doors can channel snow into said aperture of said cavity and said blower unit.

7. Said snow plow-blower apparatus as recited by claim 6, wherein said blower doors each have separate blower door controls so that said blower doors can be pivoted separately so that each of said blower doors can be adjusted to different angles and degrees in relation to one another and in relation to said blower unit and said plow head blade.

8. The snow plow-blower apparatus as recited by claim 1, wherein said cavity having said aperture with said blower doors is located substantially centrally along said plow head blade.

9. The snow plow-blower apparatus as recited by claim 1, wherein said snow blower unit is appointed to be powered by an engine of a vehicle.

10. The snow plow-blower apparatus as recited by claim 9, wherein said snow blower unit is operative to perform a snow-blowing function and said plow head blade is operative to perform a snow plowing function, and said snow-blower apparatus further comprises a control panel for starting and stopping operation of said snow blower unit, so that said snow-blowing function and said snow plowing functions can be carried out concomitantly or independently of each other.

11. The snow plow-blower apparatus as recited by claim 10, wherein said control panel is operative to move said blower doors to said open configuration upon starting of said snow blower unit and to move said blower doors to said closed configuration upon stopping snow blower unit.

12. The snow plow-blower apparatus as recited by claim 1, wherein said snow blower unit includes a blower engine for powering said snow blower unit.

13. The snow plow-blower apparatus as recited by claim 12, wherein said blower engine has a horsepower of at least about 1000 horsepower (746 kW).

14. The snow plow-blower apparatus as recited by claim 12, wherein said blower engine has a low horsepower adapted for residential use.

15. The snow plow-blower apparatus as recited by claim 12, wherein said blower engine has horsepower that varies according to commercial size/requirements necessary, including commercial or municipality commercial grade to residential use.

16. The snow plow-blower apparatus as recited by claim 12, wherein said blower engine has horsepower that varies according to commercial size/requirements necessary, wherein said blower engine is adapted to have sufficient horsepower to accommodate large projects including commercial or municipality commercial grade use, and wherein said blower engine is adapted to have sufficient horsepower to accommodate residential use.

17. The snow plow-blower apparatus as recited by claim 1, wherein said blower unit includes a power source selected from the group consisting of pneumatic (air/fluid) power, internal combustion engine power, mechanical energy power, chemical energy power, and electromagnetic energy power.

18. The snow plow-blower apparatus as recited by claim 1, wherein said scoop wings pivot on a hinge located on a side of said plow head blade.

19. The snow plow-blower apparatus as recited by claim 18, wherein said scoop wings can pivot at least 90 degrees in front of said plow head blade and at least 90 degrees behind said plow head blade.

20. The snow plow-blower apparatus as recited by claim 18, wherein said scoop wings each have separate wing controls so that each scoop wing can be pivoted separately and adjusted to different angles and degrees in relation to one another and in relation to said plow head blade.

21. Said snow plow-blower apparatus as recited by claim 1, wherein said blower doors are retractable along said plow head blade along a track and wherein a pivot hinge is provided along said blower doors so that said doors can also pivot.

22. The snow plow-blower apparatus as recited by claim 1 comprising a back blade located behind a portion of said plow head blade, and a horizontally mounted door adapted to slide open to expose said cavity of said snow blower unit housed therein, wherein said back blade directs snow into said cavity when said snow plow-blower apparatus is operating in reverse.

23. The snow plow-blower apparatus as recited by claim 1 comprising a versatility 360° chute having a long and flexible chute, wherein said snow plow-blower apparatus is appointed to also blows snow directly into a back of a truck that a snow plow-blower apparatus operator is driving and clearing a path with.

24. The snow plow-blower apparatus as recited by claim 1, wherein said blower unit includes a power source comprising hydraulic power.

25. The snow plow-blower apparatus as recited by claim 1, wherein said snow plow-blower apparatus is a size and construct so that it can be readily attached to a vehicle such as a lawnmower, quad-off road-vehicle, truck, bulldozer, skid-steer, backhoe, front end-loader, or tractor.

26. The snow plow-blower apparatus as recited by claim 1, wherein said snow plow-blower apparatus is a size and construct so that it can be readily attached to a small tractor or lawn mower for residential snow removal.

27. A snow plow-blower apparatus, comprising:

a. a plow head blade;

b. a cavity integrated within a portion of said plow head blade having an aperture with blower doors;

c. said cavity including a snow blower unit housed therein, said snow blower unit comprising at least one auger and impeller in communication with a power source wherein said auger and impeller are adapted to move snow into the blower unit and force said snow out of a discharge chute;

d. said blower doors being adapted to move into closed and open configurations wherein said blower doors move from an open to a completely closed configuration to thereby completely close said aperture of said cavity, preventing all snow ingress into said snow blower unit when said snow blower unit is not being utilized;

e. said snow blower unit is operative to perform a snow-blowing function and said plow head blade is operative to perform a snow plowing function, and said snow-blower apparatus further comprises a control panel in communication with a power source operative to start and stop operation of said snow blower unit, so that said snow-blowing function and said snow plowing functions can be carried out concomitantly or independently of each other; and f. wherein said control panel in communication with said power source is operative to move said blower doors to said open configuration upon starting of said snow blower unit and to move said blower doors to said closed configuration upon stopping said snow blower unit.

* * * * *